US006033621A

United States Patent [19]

Sizov

[11] Patent Number: 6,033,621

[45] Date of Patent: Mar. 7, 2000

[54] OXYGEN LANCE HEAD FOR TREATING MOLTEN MASSES

[75] Inventor: Anatoly Sizov, St. Petersburg, Russian Federation

[73] Assignee: Mannesmann Aktiengesellschaft, Düsseldorf, Germany

[21] Appl. No.: 09/011,008

[22] PCT Filed: Jul. 29, 1996

[86] PCT No.: PCT/DE96/01444

§ 371 Date: Jun. 10, 1998

§ 102(e) Date: Jun. 10, 1998

[87] PCT Pub. No.: WO97/05290

PCT Pub. Date: Feb. 13, 1997

[30] Foreign Application Priority Data

Aug. 2, 1995 [DE] Germany ..... 195 29 932

[51] Int. Cl.[7] ..... C21C 5/46

[52] U.S. Cl. ..... 266/225; 266/268

[58] Field of Search ..... 266/225, 265, 266/268

[56] References Cited

U.S. PATENT DOCUMENTS

| | | | |
|---|---|---|---|
| 4,702,462 | 10/1987 | Fritz | 266/225 |
| 4,746,103 | 5/1988 | Takashiba et al. | 266/225 |
| 5,746,970 | 5/1998 | Bergman et al. | 266/225 |

FOREIGN PATENT DOCUMENTS

| | | |
|---|---|---|
| 1811512 | 6/1970 | Germany . |
| 1190915 | 5/1970 | United Kingdom . |
| 9518346 | 7/1995 | WIPO . |

*Primary Examiner*—Scott Kastler

*Attorney, Agent, or Firm*—Cohen, Pontani, Lieberman & Pavane

[57] ABSTRACT

Disclosed is a lance head for a water-cooled oxygen lance for treating melts, especially for oxygen top-blowing onto steel melts in a converter, with at least one expansion nozzle which widens conically in the direction of the bath surface proceeding from a pipe portion having the narrowest nozzle cross section. This nozzle has, following the pipe portion that has the critical cross section, a first conical widening which opens into a cylindrical duct. At least one annular chamber is provided in the duct. A nozzle part which widens conically at least partially adjoins the annular chamber before the mouth of the expansion nozzle.

13 Claims, 3 Drawing Sheets

OXYGEN LANCE HEAD FOR TREATING MOLTEN MASSES

BACKGROUND OF THE INVENTION

The invention is directed to a lance head in a water-cooled oxygen lance for treating melts, especially for oxygen top-blowing onto steel melts in a converter, with at least one expansion nozzle which widens conically in the direction of the bath surface proceeding from a pipe portion having the narrowest nozzle cross section.

Oxygen lances are used in steel mills operating on the basic oxygen process. In such steel production processes, especially the LD process, as it is called, accompanying elements contained in the crude iron are removed by means of oxygen through oxidation. For this purpose, oxygen is blown onto the melt located in the converter via the-lance at high speeds of MACH 1.0 and greater.

In order for the lance head to operate in the desired manner with respect to the metallurgy of the steelmaking process, the required amount of oxygen must contact the metal melt in an optimum way via the nozzle outlet openings. The individual oxygen lance heads are designed according to specifications oriented to the particular steel mill. In particular, the converter capacity, converter dimensions, actual bath level, and the quantity and pressure of oxygen are taken into account.

DE 37 00 892 A1 discloses an oxygen lance conventionally used in steel mills for treating melts, especially for top-blowing oxygen onto the metal melts, in which is provided a plurality of gas outlet openings diverging relative to the principal axis of the lance and having the narrowest possible critical cross section, as it is called, wherein the critical cross section is adjoined in the direction of flow by a conically widening expansion nozzle.

Lances of this construction can provide only an erratic oxygen jet which disadvantageously results in unwanted steel spray and extensive dust development in the mouth region of the converter.

The object of the present invention is to provide an oxygen lance head of the generic type in which the oxygen jet makes better use of energy, improves the reaction conditions in the converter and reduces the environment burden.

This object is met by the invention through the characterizing features of claim 1. The additional claims show advantageous further developments of the invention.

The above stated object is obtained by a lance head of the invention. An annular chamber which expands in diameter radially outward is provided in this duct which can be guided virtually up to the mouth of the nozzle. As a result of this constructional shape, there is obtained a pulsing gas jet which exits the nozzle so as to be stably structured and impinges on the surface of the melt.

The nozzle is so constructed that speeds in the range of 1 to 3 Mach can be obtained at pressures of up to 15 bar. The oscillation frequency of the gas is adjustable within a range of 200 to 2000 Hz. The preferred frequency range is between 600 and 800 Hz.

As a result of the stable structure of the jet, oxygen quantities can be used with a high degree of energy utilization for blowing on or blowing in a metal melt for steel processing.

Due to the fact that the jet impinges on, the surface of the bath into a steady or smooth manner, the tendency of the molten bath to spray is eliminated and dust generation is reduced.

The stabilization of the gas jet is improved in that the construction of the annular duct is not smooth. For this purpose, the annular chamber is divided into a plurality of chamber segments divided by crosspieces or webs. The chamber segments have different radii, wherein chamber segments located opposite one another by pairs have the same radius.

In another embodiment, the outside walls of the chamber segments have radii which increase continuously in a curved manner.

In a particularly simple construction, disks are arranged in series such that the webs correspond to one another and chamber segments with different radii are arranged in the direction of flow.

The expansion part of the nozzle adjoining the annular chamber in the direction of flow can be partly cylindrical before opening conically in the region of the mouth. The cylindrical portion has a positive influence on the pulsing jet and further stabilizes it especially with respect to rotation in the axial direction.

The region of the critical diameter of the nozzle is rounded corresponding to the shape of a Laval nozzle. Further, in a simple manner as regards manufacturing technique, this region is composed of conical and cylindrical shape elements.

To further influence the desired frequency of the gas jet, one or more steps can be provided between the first conical widening in the inlet region of the nozzle and the annular chamber. The individual steps are offset from one another so as to form sharp edges and stimulate the gas jet to oscillate.

The mouth of the conical widening can have a diameter corresponding to that of the cylindrical duct. A smaller mouth diameter is provided in an advantageous manner, since, in this way, there is already a first step at the entrance to the duct by means of which a positive influence is had on the pulsing of the gas jet.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENT

Figure 1:
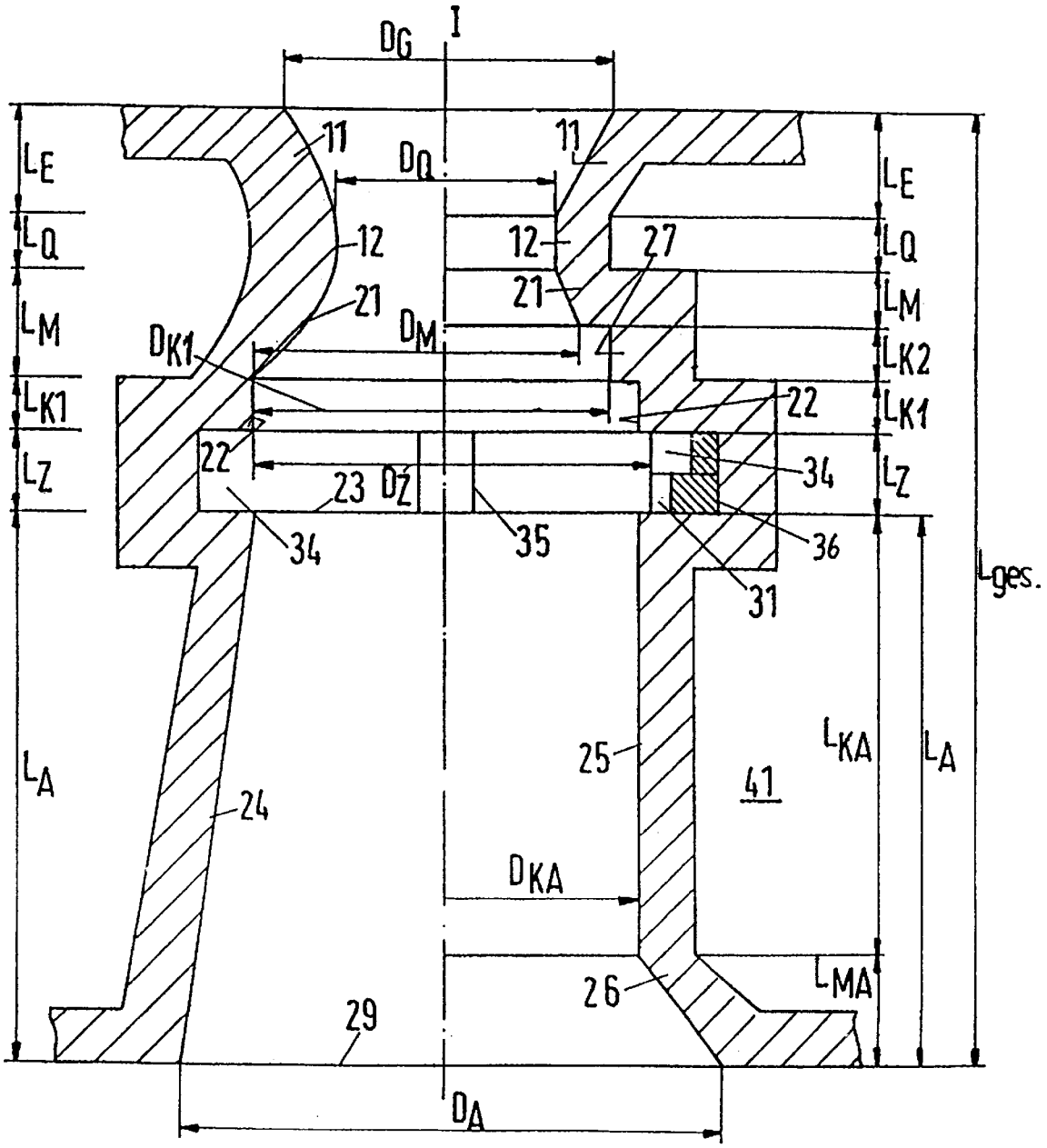
FIG. 1 shows a sectional view through a lance head of the invention.

Referring to FIG. 1, and in particular the left hand side of that figure, a conical inlet portion 11 passes in a rounded manner into a pipe portion 12 having a critical diameter $D_Q$. A first conical widening 21 adjoins this pipe portion 12 in the manner of a Laval nozzle. The first conical widening 21 opens into a duct 22 having the identical diameter.

An annular chamber 23 having an inner diameter $D_Z$ is provided in the duct at a distance $L_{K1}$ from the mouth of the first conical widening. The construction of the annular chamber is shown in FIGS. 2 and 3.

A nozzle part 24 which widens conically up to the nozzle mouth along a length $L_A$ adjoins the annular chamber 23.

A pipe portion 12 having the critical cross section $D_Q$ adjoins the conical inlet portion 11 on the right-hand side of the sectional view in FIG. 1.

Adjoining the critical cross section is a first conical widening 21 whose mouth has a diameter $D_M$ and which, in the present example, opens into a preliminary step 27 having a diameter $D_{K1}$ which is greater than diameter $D_M$.

A duct 22 which has a diameter $D_{KA}$, where $D_{KA}$ is greater than $D_{K1}$, adjoins the preliminary step 27.

An annular chamber 23 is provided in the duct 22, wherein disks 37, 38 are located in the annular chamber 23. These disks are so arranged with respect to one another that the webs 35 correspond with one another and the chamber segments have different radii.

A duct part 25 is provided behind the annular chamber 23 in the direction of flow, this duct part 25 having the same dimensions as duct 22, namely along a length $L_{KA}$, so that a second conical widening 26 adjoins at a distance $L_{MA}$ up to the mouth with diameter $D_A$. The total length $L_A$ corresponds to the sum of the cylindrical chamber length $L_{KA}$ and the length of the conical mouth $L_{MA}$.

Figure 2A:
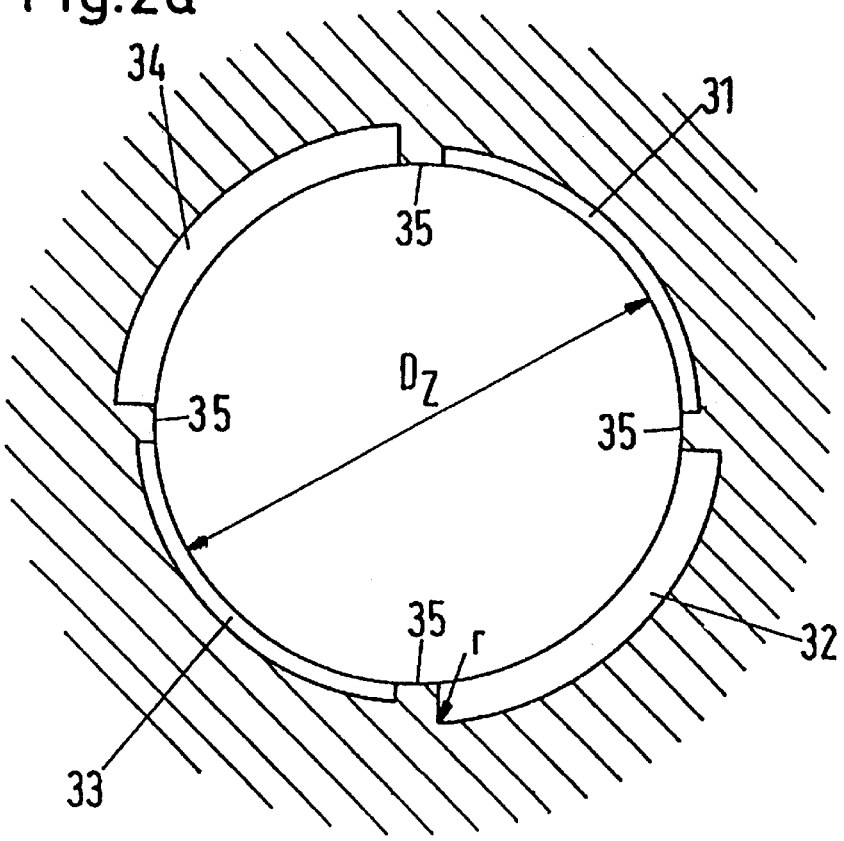
FIGS. 2*a* and 2*b* show sectional views through annular chambers with constant radii.
Figure 3:
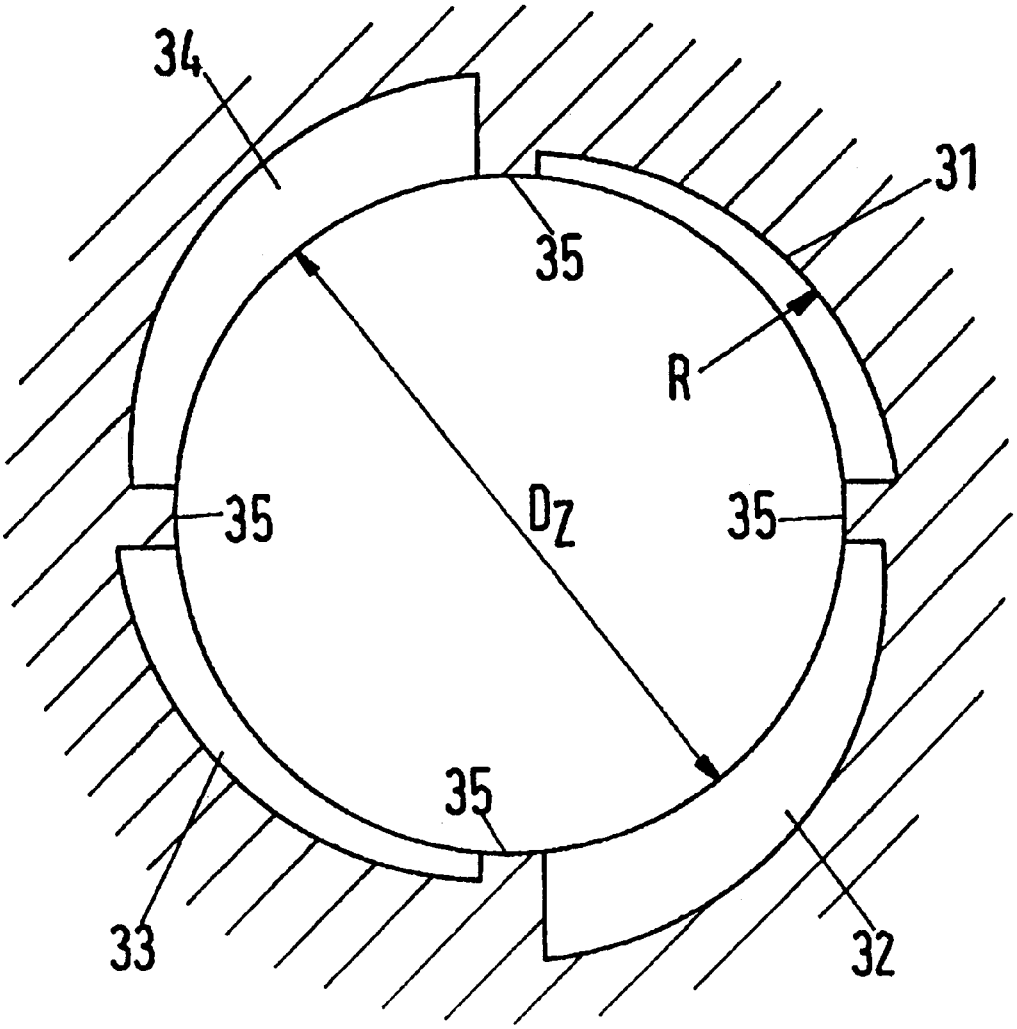
FIG. 3 shows a sectional view through the annular chamber with continuously increasing radii.

FIG. 2*a* shows a section through the annular chamber 23. In the present example, a total of four chamber segments 31 to 34 are provided, wherein the chamber segments 31 and 33 have the same radius, and thus a smaller radius than that of chamber segments 32 and 34.

The individual chamber segments are separated from one another by webs 35. The individual webs have a width which prevents influence by the individual segments. Any even number of segments above four is possible, wherein the radii of the segments located across from one another have the same magnitude. The individual chamber segments are rounded in the outer corners with a radius r.

Figure 2B:
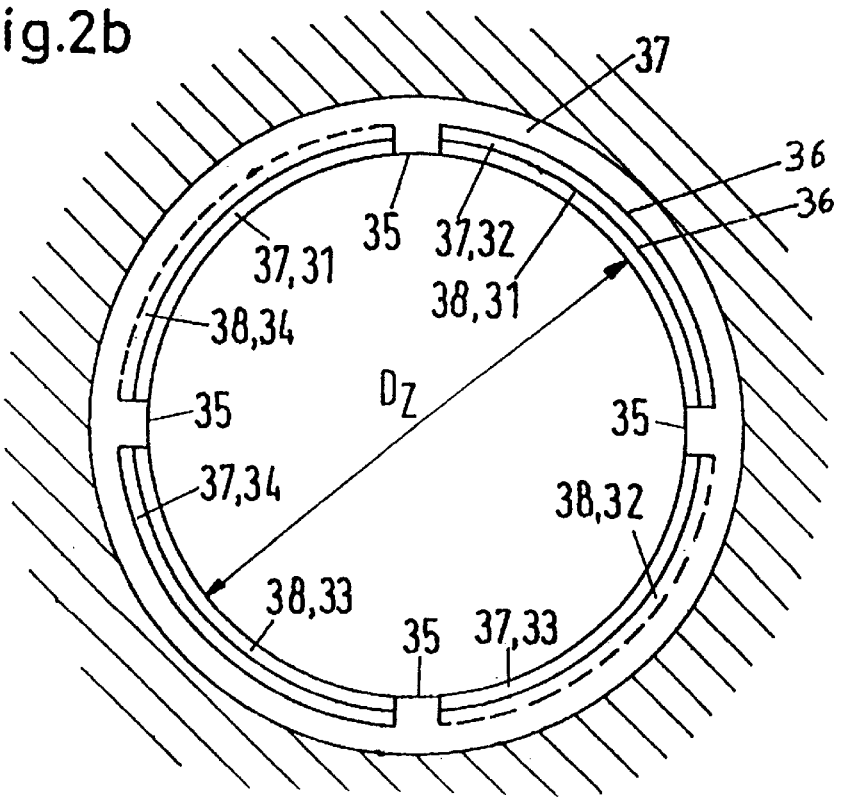

FIG. 2*b* shows the situation in which the disks are arranged one behind the other in the direction of flow. The individual segments are so arranged that a chamber segment with a small radius alternates in the direction of flow with a chamber segment with a large radius.

In a manner corresponding to FIG. 2, FIG. 3 shows an annular chamber, wherein the individual chamber segments are constructed with continuously increasing radii. The direction of rotation of the pulsing jet in particular can be influenced by this construction of the chamber segments.

Reference Numbers

Nozzle inlet
11 conical inlet portion
12 pipe portion
Expansion nozzle portion
21 first conical widening
22 duct
23 annular chamber
24 nozzle part
25 duct part
26 second conical widening
27 preliminary step
29 mouth of the expansion nozzle
Pulsing chamber
31,33 chamber segments with small radius
32,34 chamber segments with large radius
35 web
36 outer wall
37 first disk
38 second disk
Coolant line arrangement
41 cooling chamber
D diameter
L length
Subscripts:
E inlet
Q critical cross section
M mouth
Z cylindrical chamber
K duct
A outlet
I longitudinal axis of lance
r radius of chamber segment corner The terms and expressions which have been employed are used as terms of description and not of limitation, and there is no intention in the use of such terms and expressions of excluding any equivalent of the features shown and described or portions thereof, it being recognized that various modifications are possible within the scope of the invention.

I claim:

1. A lance head in a water cooled oxygen lance for treating melts, especially for oxygen top-blowing onto steel melts in a converter, comprising:

a pipe portion having a narrow nozzle cross section; and a least one expansion nozzle which widens conically, said at least one expansion nozzle extending from said pipe portion cross section, wherein the expansion nozzle comprises (i) a first conical widening with a mouth, (ii) a cylindrical duct into which said first conical widening opens, (iii) at least one annular chamber provided in the duct at a distance ($L_K$) from the mouth of the first conical widening, and (iv) a nozzle part which widens conically and at least partially adjoins the annular chamber.

2. The lance head of claim 1 wherein the pipe portion has a critical cross section.

3. The lance head of claim 1 wherein the annular chamber is divided into a plurality of chamber segments.

4. The lance head of claim 3 wherein chamber segments have arc-shaped outer walls and are arranged opposite from one another by pairs and have different radii.

5. The lance head of claim 3 wherein the chamber segments have outer walls which are curved with continuously increasing radii.

6. The lance head of claim 3 wherein the chamber segments are divided from one another by at least one web.

7. The lance head of claim 3 wherein a plurality of disks having an even number of chamber segments are inserted into the annular chamber.

8. The lance head of claim 7 wherein the plurality of disks are positioned relative to one another with correspondence between their webs such that the chamber segments with a small radius alternate in the direction of flow with those having a large radius.

9. The lance head of claim 3 wherein the chamber segments are dimensioned to achieve oscillation frequencies of the gas flowing therethrough of 200 Hz to 2000 Hz.

10. The lance head of claim 3 wherein the oscillation range is adjustable to frequencies of 600 to 800 Hz.

11. The lance head of claim 1 further comprising a preliminary step having a greater diameter than the first conical widening before the cylindrical duct in the direction of flow.

12. The lance head of claim 1 wherein diameter the first conical widening has a diameter ($D_M$) which is smaller than the diameter ($D_K$) of the duct.

13. A lance head comprising:

a pipe portion having a narrow nozzle cross section; and a least one expansion nozzle which widens conically, said at least one expansion nozzle extending from said pipe portion cross section, wherein the expansion nozzle comprises (i) a first conical widening with a mouth, (ii) a cylindrical duct into which said first conical widening opens, (iii) at least one annular chamber provided in the duct at a distance ($L_K$) from the mouth of the first conical widening, and (iv) a nozzle part which widens conically and at least partially adjoins the annular chamber.

* * * * *